US009731797B2

(12) United States Patent
Paccoud et al.

(10) Patent No.: US 9,731,797 B2
(45) Date of Patent: Aug. 15, 2017

(54) TOW PYLON ASSEMBLY FOR A WATERCRAFT

(71) Applicant: BOMBARDIER RECREATIONAL PRODUCTS INC., Valcourt (CA)

(72) Inventors: Colin Paccoud, Sherbrooke (CA); Eric Fournier, Orford (CA); Michel Bourassa, Sherbrooke (CA)

(73) Assignee: BOMBARDIER RECREATIONAL PRODUCTS INC., Valcourt, CA (US)

( * ) Notice: Subject to any disclaimer, the term of this patent is extended or adjusted under 35 U.S.C. 154(b) by 0 days.

(21) Appl. No.: 14/609,647

(22) Filed: Jan. 30, 2015

(65) Prior Publication Data

US 2016/0221650 A1 Aug. 4, 2016

(51) Int. Cl.
*B63B 35/81* (2006.01)

(52) U.S. Cl.
CPC ..... *B63B 35/815* (2013.01); *B63B 2035/818* (2013.01)

(58) Field of Classification Search
CPC ..... B63B 35/815
See application file for complete search history.

(56) References Cited

U.S. PATENT DOCUMENTS 4,934,646 A * 6/1990 Doyle ..... B65D 63/18 248/205.2
5,041,040 A 8/1991 Jones et al.
5,501,168 A 3/1996 Zachary
5,570,654 A 11/1996 Rood
5,732,648 A 3/1998 Aragon
5,788,133 A * 8/1998 Mareno ..... B63B 35/7946 114/343
5,816,184 A 10/1998 MacCulloh
5,934,217 A 8/1999 Allsop
5,943,977 A 8/1999 Womack et al.
6,021,734 A 2/2000 Sperberg
6,085,682 A 7/2000 MacCulloh
6,295,943 B1 10/2001 Bushhaber et al.
RE37,823 E 9/2002 Larson et al.
6,453,839 B2 9/2002 Roeseler et al.
6,575,112 B2 6/2003 Roeseler et al.
6,792,888 B1 9/2004 Metcalf
(Continued)

OTHER PUBLICATIONS

Bombardier Recreational Products Inc.; Wakeboard Rack; http://store.sea-doo.com/product/0/295100453/_/Wakeboard_Rack?_ga=1.154597240.1590955954.1423076350; Retrieved from internet on Feb. 9, 2015.

(Continued)

*Primary Examiner* — Edwin Swinehart
(74) *Attorney, Agent, or Firm* — BCF LLP

(57) ABSTRACT

A tow pylon assembly for a watercraft has a pylon, a base connected to a lower portion of the pylon, the base being configured for connecting the tow pylon assembly to the watercraft, a bollard connected to an upper portion of the pylon, the bollard being configured for attaching a tow rope to the tow pylon assembly, and an equipment holding assembly connected to the pylon. The equipment holding assembly has a resilient member connected to the pylon. The resilient member is configured for holding equipment between the resilient member and the pylon. A personal watercraft having a rear platform and the tow pylon assembly connected to the rear platform is also disclosed.

12 Claims, 12 Drawing Sheets

(56) References Cited

U.S. PATENT DOCUMENTS

| | | | |
|---|---|---|---|
| 6,865,999 | B2 | 3/2005 | Bierbower |
| 6,886,488 | B2 | 5/2005 | Berthiaume et al. |
| 6,986,321 | B2 | 1/2006 | Metcalf |
| 6,994,396 | B2 | 2/2006 | Burleson |
| 6,997,131 | B2 | 2/2006 | Jackson et al. |
| 7,128,014 | B2 | 10/2006 | Berthiaume et al. |
| 7,219,617 | B2 | 5/2007 | Metcalf |
| 7,234,408 | B1 * | 6/2007 | Clemmons ..... B63B 35/816 114/253 |
| 7,263,944 | B1 | 9/2007 | Smith |
| 7,370,599 | B1 | 5/2008 | Berman et al. |
| 7,571,692 | B2 | 8/2009 | Kreger |
| 7,856,937 | B2 | 12/2010 | Chapdelaine et al. |
| 8,196,542 | B2 | 6/2012 | Oswell et al. |
| 8,336,477 | B2 | 12/2012 | Walker |

OTHER PUBLICATIONS

Bombardier Recreational Products Inc.; Retractable Ski Pylon; http://store.sea-doo.com/product/0/295100457/__/Retractable__ $Ski_{13}$ Pylon?__ga=1.110025285.1590955954.1423076350; Retrieved from internet on Feb. 9, 2015.

* cited by examiner

TOW PYLON ASSEMBLY FOR A WATERCRAFT

FIELD OF TECHNOLOGY

The present technology relates to tow pylon assemblies for watercraft.

BACKGROUND

Many personal watercraft are provided with a tow eye mounted to the rear of their pedestals. The tow eye allows the attachment of a tow rope such that the personal watercraft can tow a water skier or a person riding a towable water tube for example.

However, for some water sports, such as wakeboarding, the tow eye is too low to provide ideal towing. For this reason, people who intend to use their personal watercraft for wakeboarding often mount a tow pylon to the rear of the watercraft. The tow pylon provides an attachment point for the tow rope that is higher than the tow eye.

Also, water sports implements, such as water skis, wakeskate boards and wakeboards, are too large to be stored in the storage compartments typically provided in personal watercraft. Therefore, in addition to having to mount a tow pylon, a rack or similar accessory needs to be mounted to the personal watercraft in order to provide a location where the water sport implement can be attached while it is not in use and the watercraft is in motion. Such racks are often mounted to one of the gunnels of the personal watercraft.

As such, in order to use a personal watercraft for a water sport such as wakeboarding, the personal watercraft is preferably provided with additional accessories such as the ones described above. Depending on the specific accessories being used, this can result in the accessories taking up space at both the rear and side of the personal watercraft. These accessories can also negatively impact the overall aesthetics of the personal watercraft.

SUMMARY

It is an object of the present technology to ameliorate at least some of the inconveniences present in the prior art.

In one aspect, implementations of the present technology provide a tow pylon assembly that combines the functions of a tow pylon and an equipment rack.

In one aspect, implementations of the present technology provide a tow pylon assembly for a watercraft having a pylon, a base connected to a lower portion of the pylon, the base being configured for connecting the tow pylon assembly to the watercraft, a bollard connected to an upper portion of the pylon, the bollard being configured for attaching a tow rope to the tow pylon assembly, and an equipment holding assembly connected to the pylon. The equipment holding assembly has a resilient member connected to the pylon. The resilient member is configured for holding equipment between the resilient member and the pylon.

In some implementations of the present technology, a handle connected to the upper portion of the pylon.

In some implementations of the present technology, the pylon is pivotally connected to the base. The pylon is pivotable between a towing position and a stowed position. The pylon is closer to vertical in the towing position than in the stowed position. The bollard and the equipment holding assembly are pivotable with the pylon relative to the base.

In some implementations of the present technology, a handle is connected to the upper portion of the pylon. The handle is pivotable with the pylon relative to the base. A strap is connected to the handle. The strap is configured to connect the handle to a portion of the watercraft when the pylon is in the stowed position.

In some implementations of the present technology, an arm has a first end connected to the pylon and a second end configured for being connected to the watercraft.

In some implementations of the present technology, the first end of the arm is pivotally and slidably connected to the pylon and the second end of the arm is configured for being pivotally connected to the watercraft. The arm pivots relative to the pylon as the pylon pivots between the towing and stowed positions. The arm supports the pylon and prevents pivoting of the pylon toward the stowed position when the pylon is in the towing position.

In some implementations of the present technology, the equipment holding assembly also has a support connected to a lower portion of the pylon. The support defines a recess configured to receive an edge of the equipment therein.

In some implementations of the present technology, the resilient member is an elastic having ends and a center portion. The ends of the elastic are connected to the upper portion of the pylon. The center portion of the elastic is selectively looped around the support. The elastic is configured to hold equipment between the elastic and the pylon when the center portion of the elastic is looped around the support.

In some implementations of the present technology, the equipment holding assembly also has a cap. The elastic extends through the cap. The cap is slidable along the elastic between a first position and a plurality of second positions. In the first position, the cap is received at least in part in the recess. In the second positions with the elastic looped around the support, the cap is disposed between the support and an upper end of the pylon and is configured to abut a surface of equipment held between the elastic and the pylon.

In some implementations of the present technology, the equipment is a wakeboard.

In another aspect, implementations of the present technology provide a watercraft having a hull, a deck disposed on the hull, a rear portion of the deck defining a platform, a straddle seat disposed on the deck at least in part forward of the platform, a base connected to the platform, a pylon having a lower portion connected to the base, a bollard connected to an upper portion of the pylon, the bollard being configured for attaching a tow rope, and an equipment holding assembly connected to the pylon. The equipment holding assembly comprises a resilient member connected to the pylon. The resilient member is configured for holding equipment between the resilient member and the pylon.

In some implementations of the present technology, a handle connected to the upper portion of the pylon.

In some implementations of the present technology, the pylon is pivotally connected to the base. The pylon is pivotable between a towing position and a stowed position. The pylon is closer to vertical in the towing position than in the stowed position. The bollard and the equipment holding assembly are pivotable with the pylon relative to the base.

In some implementations of the present technology, a first handle is connected to the deck and disposed at least in part rearward of the straddle seat. A second handle is connected to the upper portion of the pylon. The second handle being pivotable with the pylon relative to the base. A strap is connected to the second handle. The strap selectively connects the second handle to the first handle when the pylon is in the stowed position.

In some implementations of the present technology, an arm has a first end connected to the pylon and a second end connected to the deck.

In some implementations of the present technology, the deck defines a pedestal. The straddle seat is disposed on the pedestal. The pylon is rearward of the pedestal at least when in the towing position. The watercraft also has a tow eye connected to a rear of the pedestal. The first end of the arm is pivotally and slidably connected to the pylon and the second end of the arm is pivotally connected to the tow eye. The arm pivots relative to the pylon as the pylon pivots between the towing and stowed positions. The arm supports the pylon and prevents pivoting of the pylon toward the stowed position when the pylon is in the towing position.

In some implementations of the present technology, the equipment holding assembly also has a support connected to a lower portion of the support. The support defines a recess configured to receive an edge of the equipment therein.

In some implementations of the present technology, the resilient member is an elastic having ends and a center portion. The ends of the elastic are connected to the upper portion of the pylon. The center portion of the elastic is selectively looped around the support. The elastic is configured to hold equipment between the elastic and the pylon when the center portion of the elastic is looped around the support.

In some implementations of the present technology, the equipment holding assembly also has a cap. The elastic extends through the cap. The cap is slidable along the elastic between a first position and a plurality of second positions. In the first position, the cap is received at least in part in the recess. In the second positions with the elastic looped around the support, the cap is disposed between the support and an upper end of the pylon and is configured to abut a surface of equipment held between the elastic and the pylon.

In some implementations of the present technology, the equipment is a wakeboard.

For purposes of this application, terms related to spatial orientation such as forwardly, rearward, left, and right, are as they would normally be understood by a driver of the watercraft sitting thereon in a normal driving position.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

The present technology will be described with respect to a personal watercraft 10. However, it should be understood that other types of watercraft are contemplated.

The general construction of a personal watercraft 10 will be described with respect to FIGS. 1 and 2. The following description relates to one way of manufacturing a personal watercraft. It should be recognized that there are other known ways of manufacturing and designing watercraft and that the present technology would encompass other known ways and designs.

Figure 1:
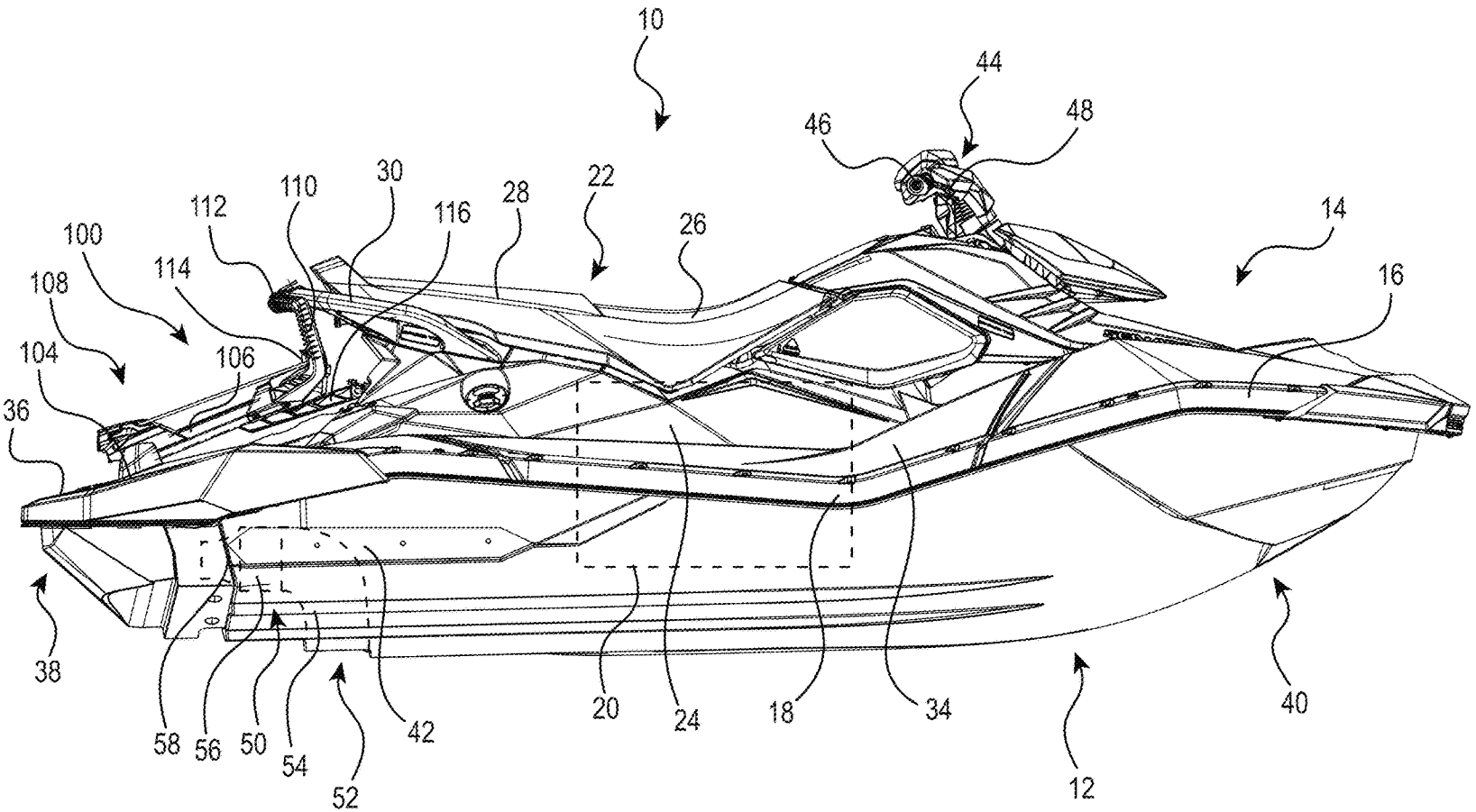
FIG. 1 is a right side elevation view of a personal watercraft having a tow pylon assembly, with a pylon of the tow pylon assembly in a stowed position.

The watercraft 10 of FIG. 1 has a hull 12 and a deck 14. The hull 12 buoyantly supports the watercraft 10 in the water. The deck 14 is designed to accommodate a driver and two passengers. The hull 12 and deck 14 are joined together at a seam 16 that joins the parts in a sealing relationship. The seam 16 comprises a gasket between the hull 12 and deck 14 that is compressed by fasteners. Adhesives can also join the hull 12 and the deck 14 together. Other known joining methods could be used to engage the parts together, including but not limited to, thermal bonding. A multi-part bumper 18 generally covers the seam 16, which helps to prevent damage to the outer surface of the watercraft 10 when the watercraft 10 is docked, for example.

The space between the hull 12 and the deck 14 forms a volume commonly referred to as the motor compartment. The motor compartment accommodates a motor 20 (schematically shown in dotted lines in FIG. 1). In the present implementation, the motor 20 is an internal combustion engine 20. It is contemplated that the motor 20 could be any other type of motor such as an electric motor or a combination of an internal combustion engine and an electric motor. The motor compartment also accommodates a muffler, gas tank, electrical system (battery, electronic control unit, etc.), air box, storage bins, and other elements required or desirable in the watercraft 10.

The deck 14 has a straddle seat 22 positioned on top of a pedestal 24 to accommodate the driver and the passengers in a straddling position. The straddle seat 22 is laterally centered on the deck 14. As seen in FIG. 1, the seat 22 includes a front seat portion 26 to accommodate the driver and a rear, raised seat portion 28 to accommodate the passengers. The seat 22 is made as a cushioned unit. The seat 22 is removably attached to the pedestal 24 by a hook and tongue assembly (not shown) at the front of the seat 22 and by a latch assembly (not shown) at the rear of the seat 22. It is contemplated that any other known attachment mechanism could be used. A small storage box (not shown) is provided in the deck in front of the seat 22.

Figure 2:
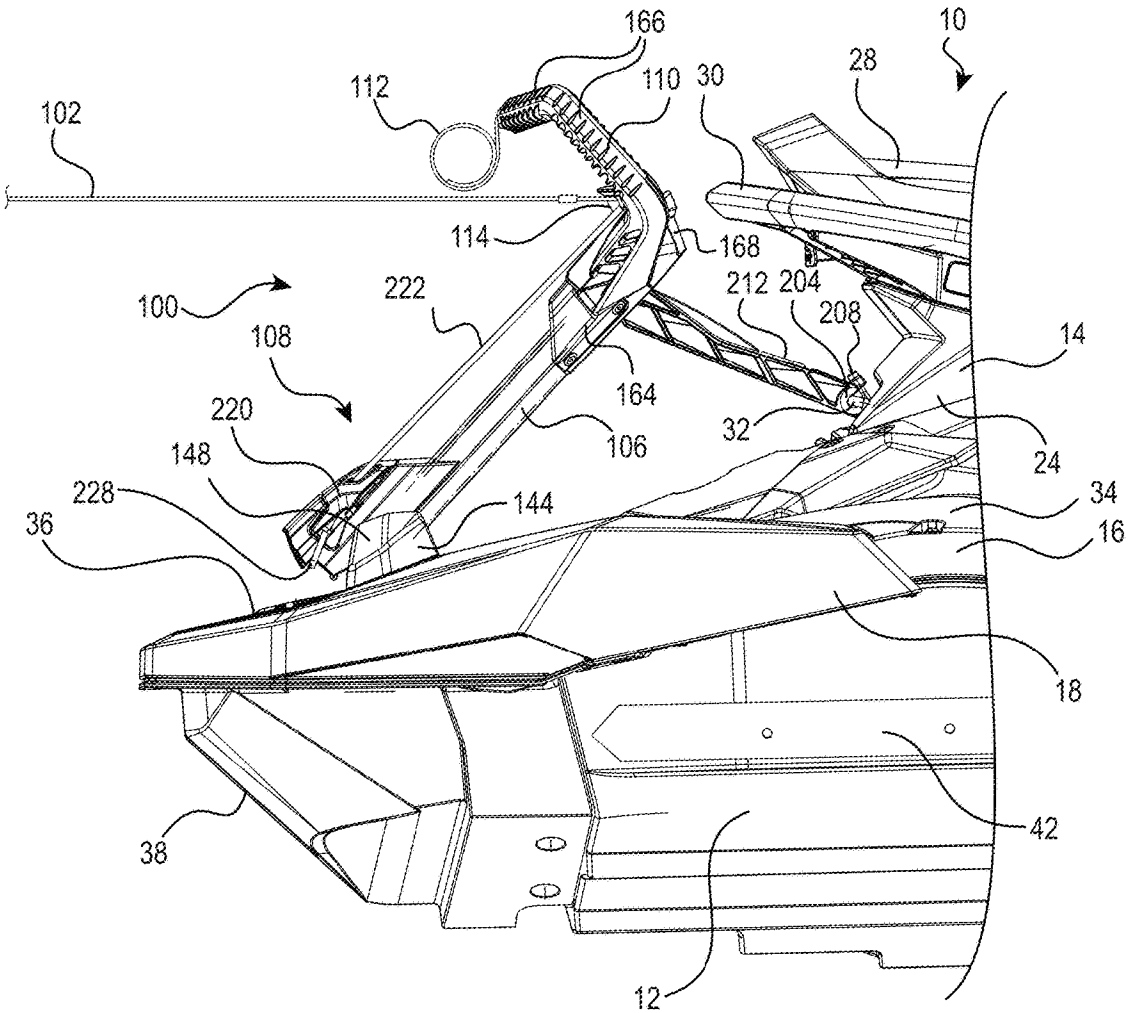
FIG. 2 is a right side elevation view of a rear portion of the personal watercraft and the tow pylon assembly of FIG. 1, with the pylon in a towing position and a tow rope connected to the tow pylon assembly.

As best seen in FIG. 2, a grab handle 30 is provided between the pedestal 24 and the rear of the seat 22 to provide handholds onto which the rearmost passenger may hold. As can be seen, a portion of the grab handle 30 extends rearward of the rear seat portion 28. Beneath the handle 30, a tow eye 32 is connected to the rear of the pedestal 30. In the present implementation, the tow eye 32 is a horizontally extending U-clamp fastened to the pedestal 30, but it is contemplated that other types of tow eye could be used. In some implementations, it is contemplated that the tow eye 32 could be omitted.

The watercraft 10 has a pair of generally upwardly extending walls located on either side of the watercraft 10 known as gunwales or gunnels 34. The gunnels 34 help to prevent the entry of water in the footrests (not shown) disposed between the gunnels 34 and the pedestal 24. The gunnels 34 also provide lateral support for the riders' feet, and provide buoyancy when turning the watercraft 10, since personal watercraft roll slightly when turning.

A reboarding platform 36 is provided at the rear of the watercraft 10 and is defined by a rear portion of the deck 14 to allow easy reboarding of the watercraft 10 from the water. Carpeting or some other suitable covering covers the reboarding platform 36. A retractable ladder or pedal (not shown) may be affixed to the transom 38 to facilitate boarding of the watercraft 10 from the water onto the reboarding platform 36. A tow pylon assembly 100 is connected to the reboarding platform 36. The tow pylon assembly 100 is movable between a stowed position shown in FIG. 1 and a towing position shown in FIG. 2. When the tow pylon assembly 100 is in the towing position, a tow rope 102 can be attached to the tow pylon assembly 100 thus permitting a wakeboarder, wakeskater or water skier, for example, to be towed by the watercraft 10. The tow pylon assembly 100 will be described in more detail below.

The hull 12 has a transom 38 and a bow 40. The hull 12 is provided with a combination of strakes and chines. A strake is a protruding portion of the hull 12. A chine is the vertex formed where two surfaces of the hull 12 meet. The combination of strakes and chines provide the watercraft 10 with its riding and handling characteristics. Sponsons 42 are located on both sides of the hull 12 near the transom 38. The sponsons 42 give the watercraft 10 both lift while in motion and improved turning characteristics. The sponsons 42 are fixed to the surface of the hull 12 by fasteners. It is contemplated that the position of the sponsons 42 could be adjusted with respect to the hull 12 to change the handling characteristics of the watercraft 10 and accommodate different riding conditions.

A helm assembly 44 is positioned forwardly of the seat 22. The helm assembly 44 has a padded central helm portion and a pair of steering handles 46, also referred to as a handlebar. The right steering handle 46 is provided with a throttle operator 48, which allows the rider to control the engine 20, and therefore the speed of the watercraft 10. The throttle operator 48 is a finger-actuated throttle lever. It is contemplated that the throttle operator could alternatively be a thumb-actuated throttle lever or a twist grip. The left steering handle 46 (not shown) is provided with a deceleration device in the form of a lever (not shown) used by the driver to decelerate the watercraft 10 and make the watercraft 10 move in a reverse direction.

The watercraft 10 is propelled by a jet propulsion system 50 (schematically shown in dotted lines in FIG. 1). The jet propulsion system 50 pressurizes water to create thrust. The water is first scooped from under the hull 12 through an inlet 52, which has an inlet grate (not shown in detail). The inlet grate prevents large rocks, weeds, and other debris from entering the jet propulsion system 50, which may damage the system or negatively affect performance. Water flows from the inlet through a water intake ramp 54. The top portion of the water intake ramp 54 is formed by the hull 12, and a ride shoe (not shown) forms its bottom portion. Alternatively, the intake ramp 54 may be a single piece or an insert to which the jet propulsion system 50 attaches. In such cases, the intake ramp 54 and the jet propulsion system 50 are attached as a unit in a recess in the bottom of hull 12.

From the intake ramp 54, water enters the jet propulsion system 50. The jet propulsion system 50 is located in a formation in the hull 12, referred to as the tunnel (not shown). The tunnel is defined at the front, sides, and top by walls formed by the hull 12 and is open at the transom 38. The bottom of the tunnel is closed by a ride plate (not shown). The ride plate creates a surface on which the watercraft 10 rides or planes at high speeds.

The jet propulsion system 50 includes a jet pump 56. The forward end of the jet pump 56 is connected to the front wall of the tunnel. The jet pump 56 includes an impeller (not shown) and a stator (not shown). The impeller is coupled to the engine 20 by one or more shafts (not shown), such as a driveshaft and an impeller shaft. The rotation of the impeller pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet pump 56, it goes through a venturi 58 that is connected to the rearward end of the jet pump 56. Since the venturi's exit diameter is smaller than its entrance diameter, the water is accelerated further, thereby providing more thrust. A steering nozzle (not shown) is rotationally mounted relative to the venturi 58 so as to pivot about a steering axis.

The steering nozzle is operatively connected to the helm assembly 44 via a push-pull cable (not shown) such that when the helm assembly 44 is turned, the steering nozzle pivots about a steering axis. This movement redirects the pressurized water coming from the venturi 58, so as to redirect the thrust and steer the watercraft 10 in the desired direction.

The jet propulsion system 50 is provided with a reverse gate (not shown) which is movable between a fully stowed position where it does not interfere with a jet of water being expelled by the steering nozzle and a plurality of positions where it redirects the jet of water being expelled by the steering nozzle. The reverse gate can be actuated by the driver of the watercraft 10 by using the deceleration device provided on the left steering handle 46. When the reverse gate redirects the jet of water being expelled by the steering nozzle toward a front of the watercraft 10, the watercraft 10 is decelerated or moves in a reverse direction depending on its operating condition. One example of a suitable reverse gate is described in U.S. Pat. No. 7,674,144, issued on Mar. 9, 2010, the entirety of which is incorporated herein by reference.

Turning now to FIGS. 3 to 13, the tow pylon assembly 100 will be described. The tow pylon assembly 100 has a base 104, a pylon 106 pivotally connected to the base 104, an equipment holding assembly 108 connected to the pylon 106, a handle 110 connected to the pylon 106, a strap 112 connected to the handle 110, a bollard 114 connected to the handle 110 and an arm 116 pivotally and slidably connected to the pylon 106. The base 104, portions of the equipment holding assembly 108, the handle 110, the bollard 114 and the arm 116 are made of plastic and are formed by injection molding. The pylon 106 is an aluminum extrusion. Various types of fasteners used in the tow pylon assembly 100, such as bolts, screws and rivets, will be described below. It is contemplated that fasteners other than the ones described below could be used.

The base 104 is used to fasten the tow pylon assembly 100 to the platform 36 of the watercraft 10. The base 104 defines two rear apertures 118 (only the right one being visible in FIG. 4) through which fasteners (not shown) are inserted to fasten the base 104 to the platform 36. The base 104 also has two posts 120 forwardly of the apertures 118 that extend through apertures (not shown) in the platform 36. The posts 120 define apertures 122 therethrough. Fasteners (not shown) are inserted through the apertures 122 to fasten the base 104 to the platform 36. Sealing washers and/or sealant, such as caulk, is provided around the fasteners between the base 104 and the platform 36 to prevent water intrusion inside the watercraft 10.

Figure 3:
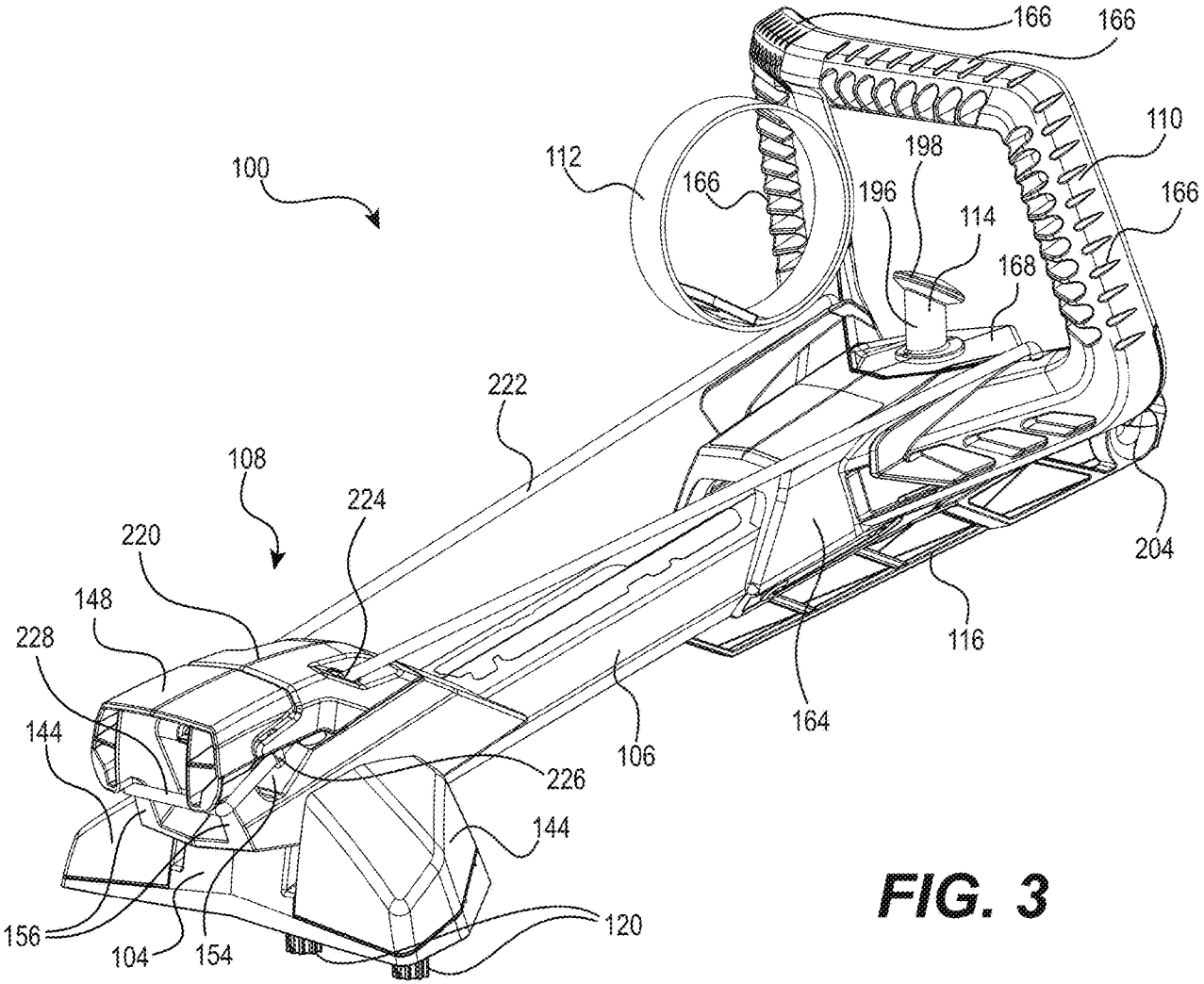
FIG. 3 is a perspective view taken from a rear, right side of the tow pylon assembly of FIG. 1, with the pylon in the stowed position.
Figure 4:
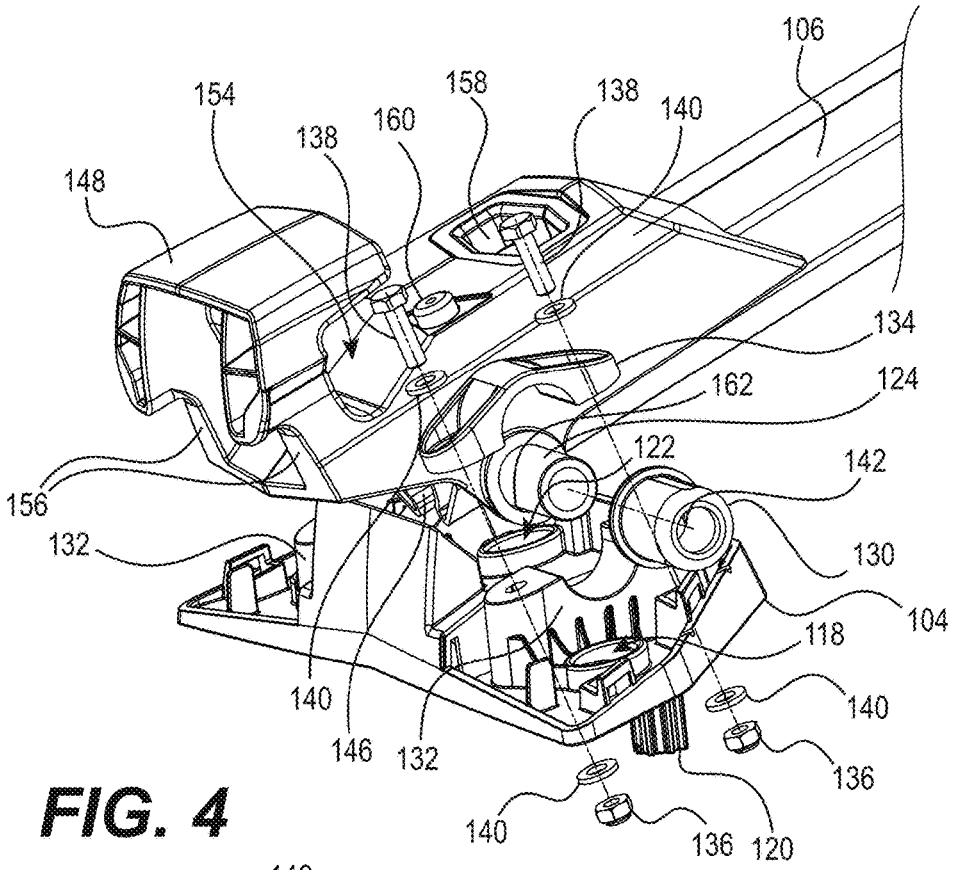
FIG. 4 is an exploded view of a lower portion of the tow pylon assembly of FIG. 3.
Figure 5:
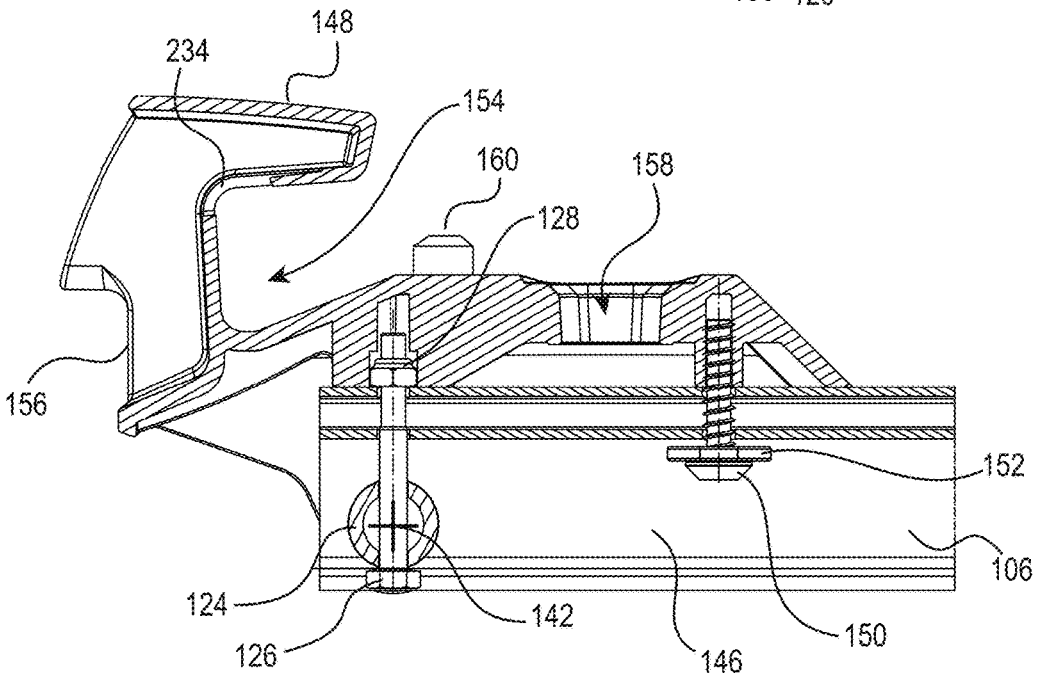
FIG. 5 is a partial cross-sectional view of the pylon and a support of the tow pylon assembly of FIG. 3, taken through a center of the pylon.

The pylon 106 is pivotally connected to the base 104. A shaft 124 is inserted laterally through the lower portion of the pylon 106. As can be seen in FIG. 5, a bolt 126 is inserted through the shaft 124 and the pylon 106. The bolt 126 is laterally centered with respect to the pylon 106. A nut 128 is fastened onto the end of the bolt 126 protruding from the pylon 106. As a result, the bolt 126 prevents the shaft from rotating and moving laterally with respect to the pylon 106. As can be seen in FIG. 4, the ends of the shaft 124 protrude laterally from the pylon 106. Bushings 130 (only one of which can be seen in FIG. 4) are disposed over the ends the shaft 124. The ends of the shaft 124 and the bushings 130 are received in bushing seats 132 defined in the base 104. Clamps 134 are fastened with nuts 136, bolts 138 and washers 140 to the bushing seats 132. The bushing seats 132 and the clamps 134 retain the shaft 124 and bushings 130 therebetween. The shaft 124, and therefore the pylon 106 and components attached to the pylon 106, pivot relative to the base 104 inside the bushing seats 132 and clamps 134 about a pivot axis 142 corresponding to the central axis of the shaft 124. Two caps 144 (FIG. 3) are clipped onto the base 104 to hide the connection between the base 104 and the platform 36 and between the shaft 124 and the base 104.

Figure 6:
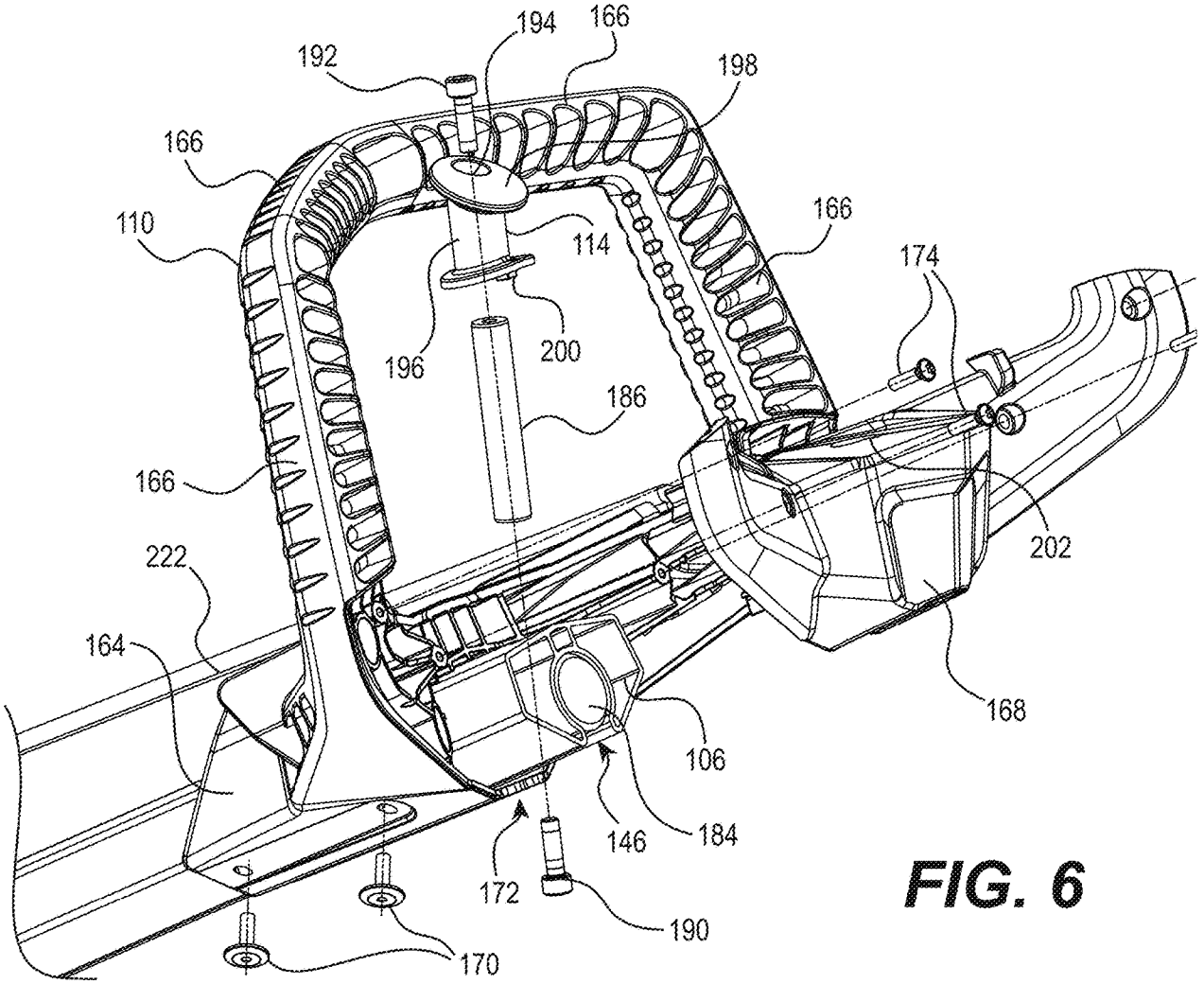
FIG. 6 is an exploded view of an upper portion of the tow pylon assembly of FIG. 3.
Figure 10:
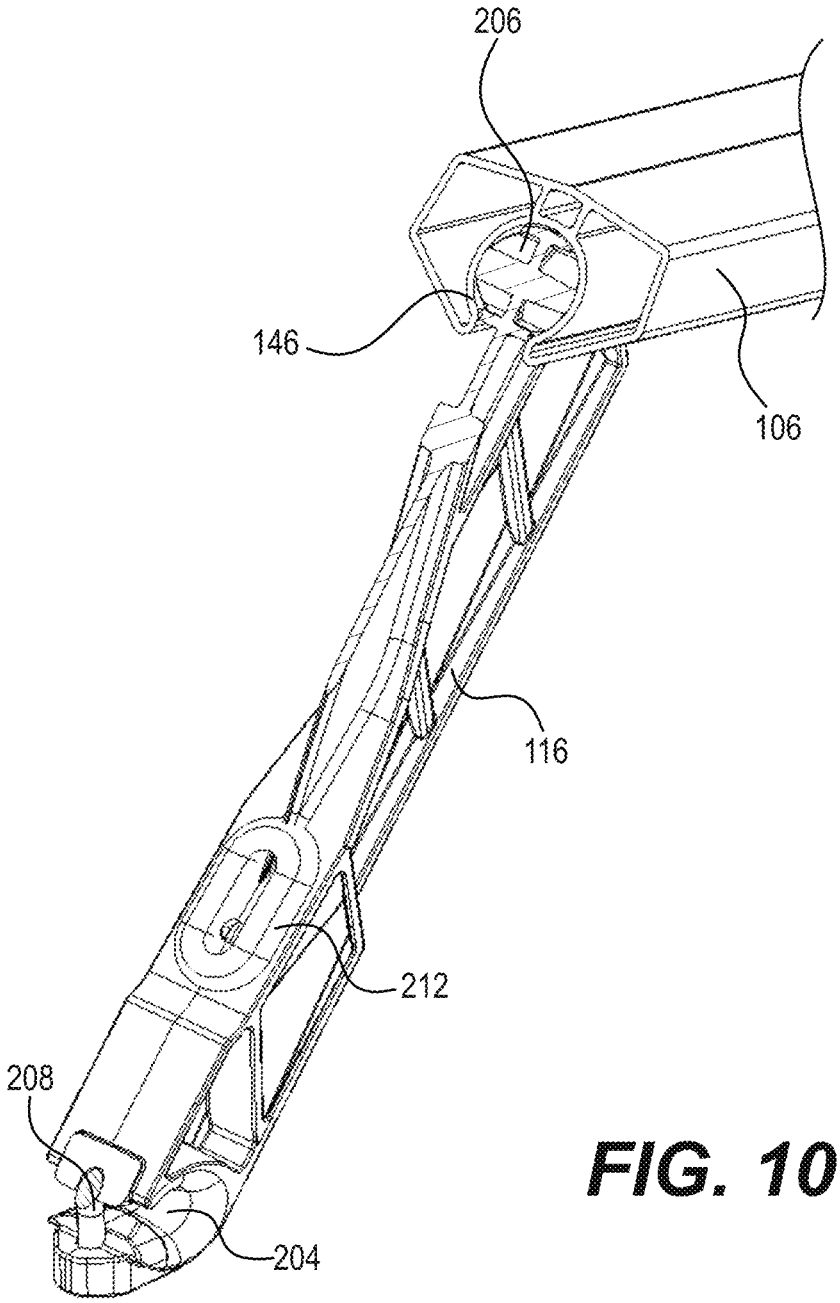
FIG. 10 is a cross-sectional view of a portion of the tow pylon assembly taken along line 10-10 of FIG. 9.

As best seen in FIGS. 6 and 10, the outer perimeter of the pylon 106 has a generally hexagonal cross-section. The pylon 106 defines a channel 146 that opens in the surface of the pylon 106 that generally faces the deck 14 when the tow pylon assembly 100 is mounted to the watercraft 10. As can be seen, the channel 146 has a semi-circular cross-section. The channel 146 extends the entire length of the pylon 106. As can be seen in FIG. 5, the bolt 126 is disposed in part inside the channel 146 such that the head of the bolt 126 does not protrude from the pylon 126.

Figure 12:
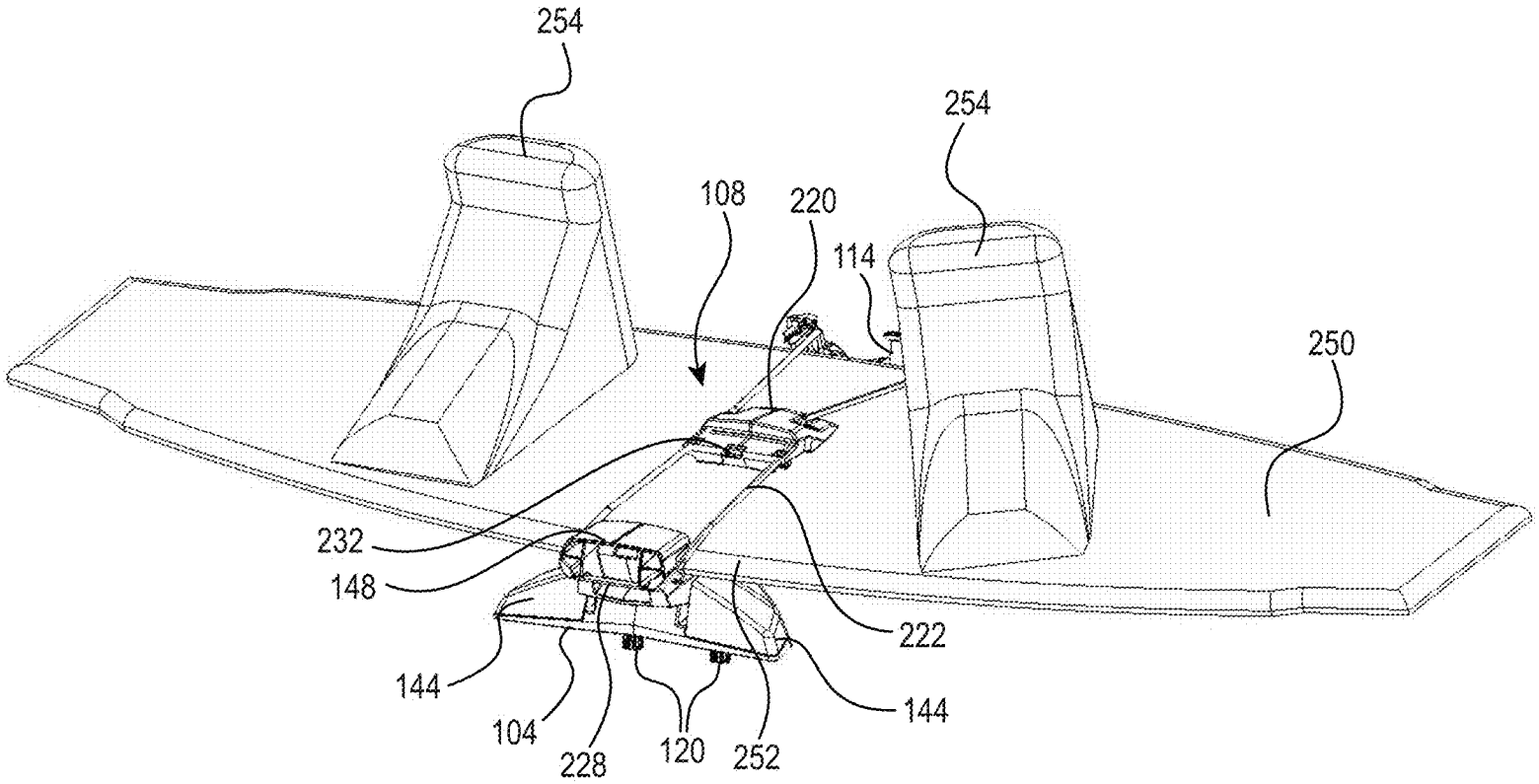
FIG. 12 is a perspective view taken from a rear, right side of the tow pylon assembly with the pylon in the stowed position and a wakeboard held by the tow pylon assembly, with the handle of the tow pylon assembly removed.
Figure 13:
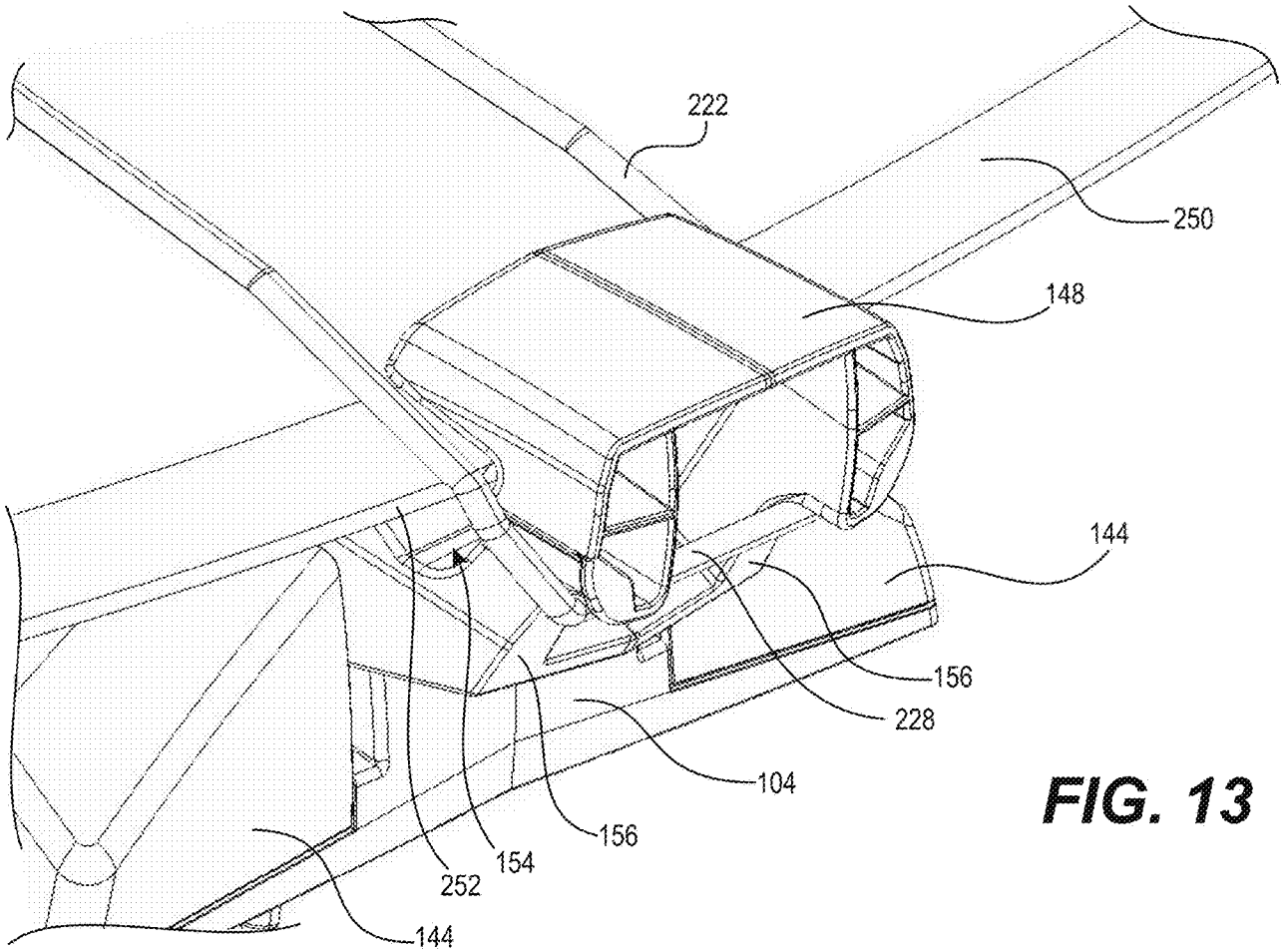
FIG. 13 is a perspective view taken from a rear, left side of a lower portion of the tow pylon assembly and wakeboard of FIG. 12.

A support 148 is connected to the lower portion of the pylon 106. The support 148 forms part of the equipment holding assembly 108, which will be described in greater detail below. A screw 150 fastens the support 148 to the pylon 106. As can be see in FIG. 5, the head of the screw 150 is disposed inside the channel 146. A washer 152 is disposed between the head of the screw 150 and the pylon 106. The support 148 defines a recess 154. The recess 154 opens toward the handle 110. The recess 154 is configured to receive an edge of the equipment to be held by the equipment holding assembly 108, such as an edge 252 of a wakeboard 250 as can be seen in FIGS. 12 and 13 and as will be described in greater detail below. The support 148 defines a pair of generally inverted L-shaped surfaces 156, for purposes described below. The support 148 also defines a hexagonal aperture 158. The hexagonal aperture 158 is configured to receive an anchor (not shown) therein. This anchor can be used to connect various items to the tow pylon assembly 100. U.S. Pat. No. 8,777,531 B2, issue Jul. 15, 2014, the entirety of which is incorporated herein by reference, discloses an anchor suitable for use with the aperture 158. A pair of rubber bumpers 160 is mounted to the support 148 at a position between the portion of the support 148 defining the recess 154 and the hexagonal apertures 158. Equipment held by the equipment holding apparatus 108 abuts the bumpers 160 which help prevent the equipment from sliding relative to the support 148. The support 148 also defines a pair of side apertures 162 (FIG. 4) through which the shaft 124 extends.

As mentioned above, the handle 110 is connected to the upper portion of the pylon 106. As best seen in FIG. 6, the handle 110 has a central member 164, four handholds 166 and a cap 168. The central member 164 is slid over the upper portion of the pylon 106 and connected to the pylon 106 by rivets 170. The central member 164 defines a slot 172 in lateral alignment with the channel 146 of the pylon 106. The four handholds 166 are integrally formed with the central member 164. The four handholds 166 are arranged in a generally C-shaped arrangement so as to form a closed perimeter with the central member 164. The two generally laterally extending handholds 166 generally follow a shape of a rear side of the grab handle 30 when the pylon 106 is in the stowed position (see FIG. 1). The four handholds 166 provide multiple positions where a passenger of the watercraft 10 facing backward can hold the handle 110 when the pylon 106 is in the towing position. It is contemplated that more or less than four handholds 166 could be provided. The cap 168 is fastened to the central member 164 by screws 174 (only some of which are shown). The cap 168 covers the upper end of the pylon 106. The cap 168 defines a slot 176 (FIG. 11) in lateral alignment with the channel 146 of the pylon 106 and the slot 172 of the central member 164. It is contemplated that the handle 110 could be omitted, in which case a passenger of the watercraft 10 facing rearward to spot a wakeboarder for example would hold onto the grab handle 30 of the watercraft 10 and components connected to the handle 110 would be connected directly to the upper portion of the pylon 106 or to another component mounted to the upper portion of the pylon 106.

Figure 7:
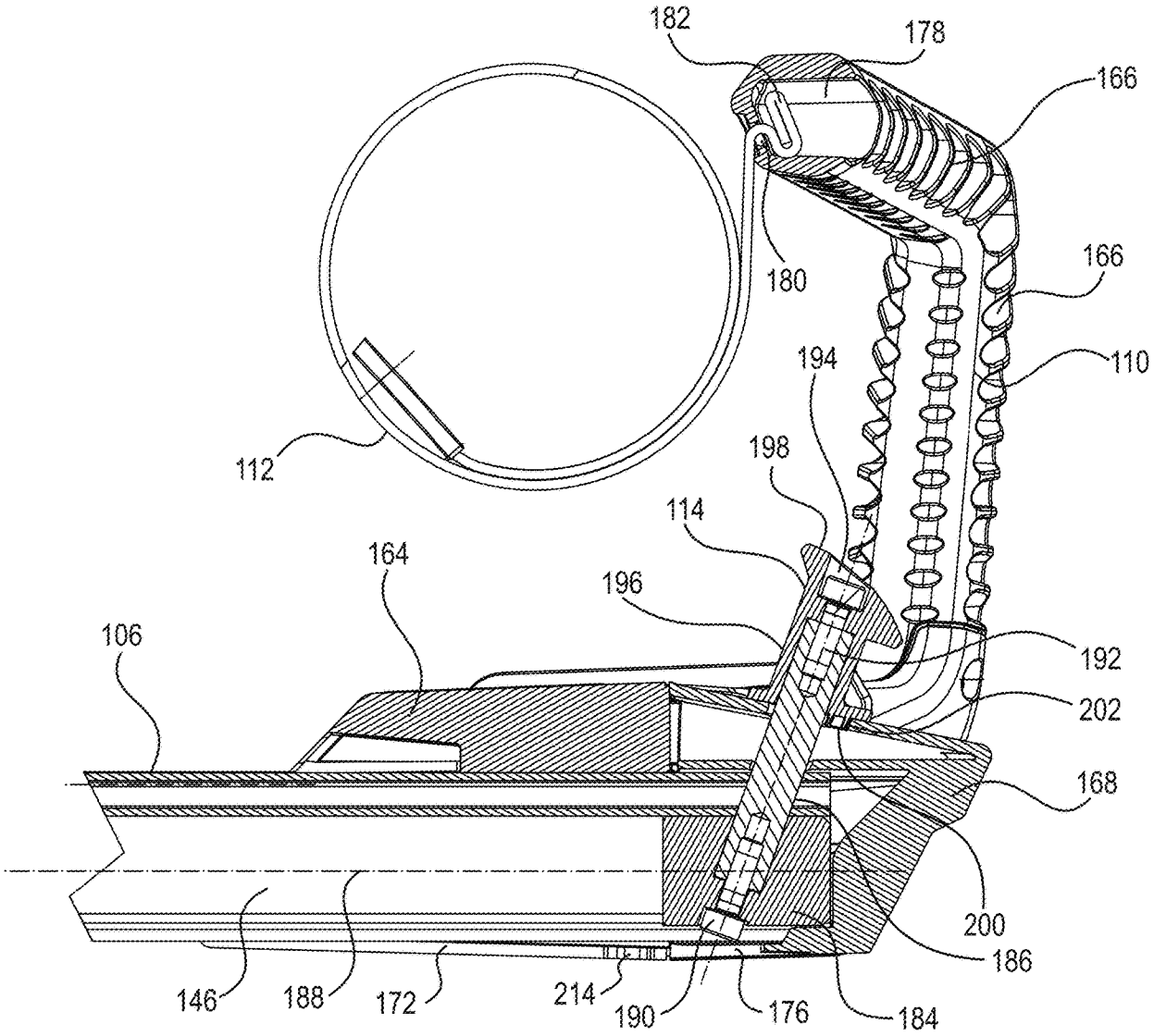
FIG. 7 is a cross-sectional view of a portion of the pylon, a bollard, a handle and a strap of the tow pylon assembly of FIG. 3, taken through a center of the pylon.

As can be seen in FIG. 7, the two laterally extending handholds 166 define an inner chamber 178 and an aperture 180 communicating the chamber 178 with an exterior of the handholds 166. The strap 112 has an end 182 that is folded and pressed through the aperture 180 such that once the end 182 is inside the chamber 178, it is retained therein. It is contemplated that in an alternative implementation, the end 182 could be fastened or bonded to the handholds 166 or tied around the handholds 166. In the present implementation, the strap 112 is a band of material having hooks on one side thereof and loops on the other side thereof, such that when the strap 112 is looped as shown in FIG. 1, 2 or 7, part of the side having the hooks engages part of the side having the loops, thereby creating a mechanical bond therebetween. As shown in FIG. 1, when the pylon 106 is in the stowed position, the strap 112 is wrapped around both the laterally extending handholds 166 and the rear portion of the grab handle 30 of the watercraft 10, thereby helping to keep the tow pylon 106 in the stowed position. In the present implementation, the strap 112 is designed to be long enough to allow the strap 112 to be wrapped around the laterally extending handholds 166, the rear portion of the grab handle 30 and around the tow rope 102 which has been folded up, thereby conveniently securing the tow rope 102 when it is not in use. It is contemplated that the hook and loop band forming the strap 112 could be replaced by a rope or by a band of material having a hook, a snap fastener or another type of fastener. In an alternative implementation, it is contemplated that the strap 112 could be replaced by another element or elements that could be used to connect the laterally extending handholds 106 to the grab handle 30 when the pylon 106 is in the stowed position, such as a clip for example. It is also contemplated that the strap 112 could be omitted.

Figure 9:
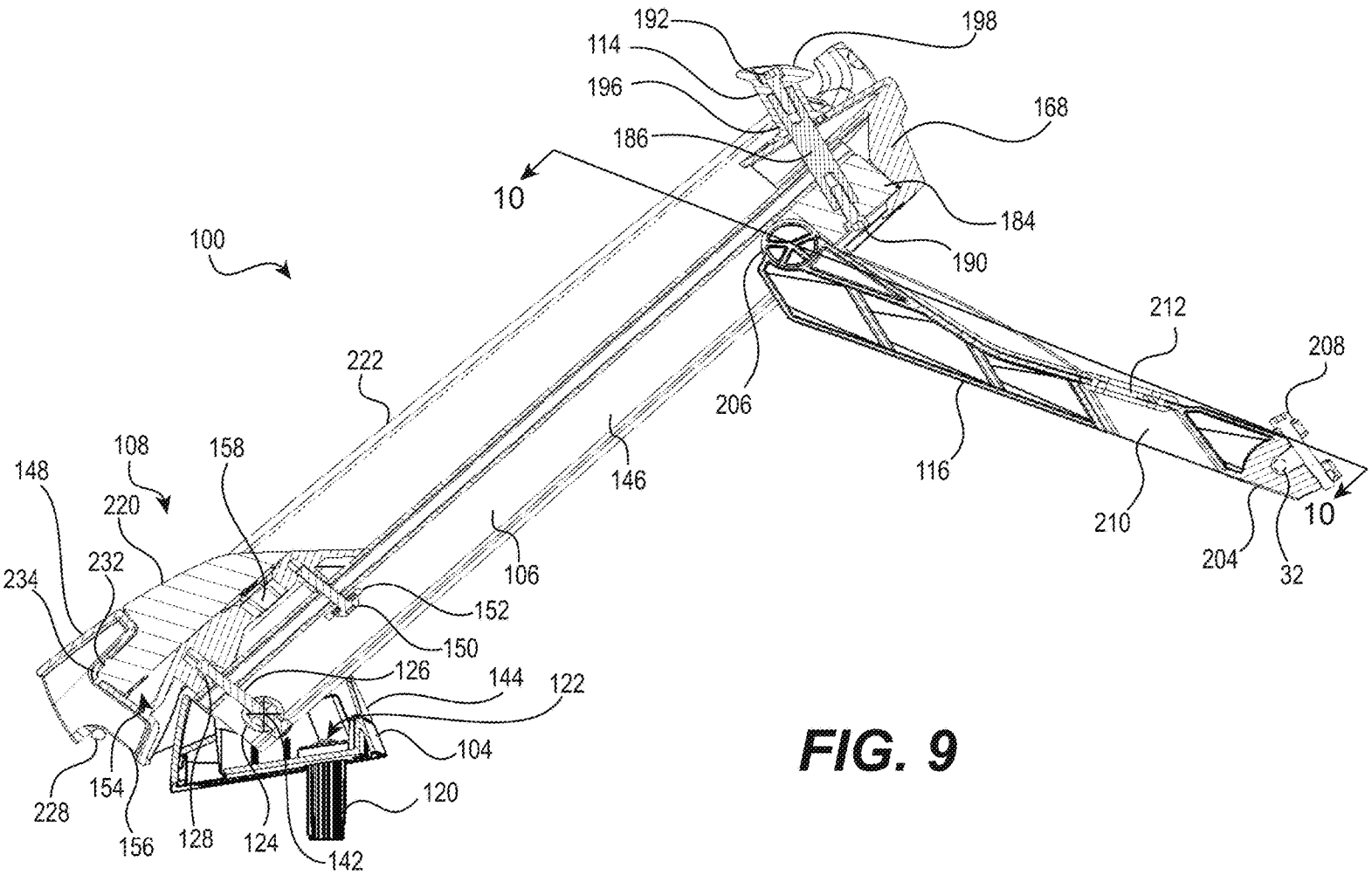
FIG. 9 is a cross-sectional view of the tow pylon assembly of FIG. 3 taken along a center of the pylon, with the pylon in the towing position and the handle removed.

As can be seen in FIGS. 6, 7 and 9, a cylindrical pin 184 is inserted inside the channel 146 at the top of the pylon 106. As best seen in FIG. 7, another cylindrical pin 186 is inserted through the cap 168, the pylon 106 and into the pin 184. The pin 186 is skewed relative to the central axis 188 of the pin 184. A screw 190 fastens the pin 186 to the pin 184. The bollard 114 is fastened by another screw 192 to the other end of the pin 186 such that the bollard 114 sits on an outer surface of the cap 168. As can be seen in FIGS. 6 and 7, the bollard defines a recess 194 to receive the head of the screw 192, such that the head of the screw 192 does not protrude from the bollard 114. The bollard 114 has a cylindrical body 196 and a flange 198. As can be seen, the flange 198 is skewed relative to the cylindrical body 196 of the bollard 114. The angle between the cylindrical body 196 and the flange 198 of the bollard 114 is selected such that when the pylon 106 is in the towing position, the flange 198 is generally horizontal as can be seen in FIG. 9. As the bollard 114 is not symmetrical, the bollard 114 defines a protrusion 200 that is received in a corresponding notch 202 of the cap 168, thus ensuring that the bollard 114 is oriented properly when installed.

As best seen in FIGS. 9 and 10, the arm 116 defines a hook 204 at one end thereof and a ball 206 at the other end thereof. The hook 204 receives the tow eye 32 (shown in dotted lines in FIG. 9) therein. A bolt 208 is fastened to the end of the arm 116 defining the hook 204 such that the bolt 208 extends across the gap defined by the hook 204. As a result, the tow eye 32 is held captive in the hook 204 and the arm 116 is pivotally connected to the rear of the pedestal 24. It is contemplated that the arm 116 could be pivotally connected to the pedestal 24 by other means, such as by a hinge for example, in which case it is contemplated that the tow eye 32 could be omitted. The ball 206 is received in the channel 146 defined by the pylon 106. The ball 206 is inserted in the channel 146 before the pin 184 is inserted in the channel 146. The ball 206, and therefore the arm 116, can slide along the channel 146 and pivots inside the channel 146 as it slides. The pin 184 acts as a stopper and prevents the ball 206 from coming out of the channel 146 as can be seen in FIG. 9. In an alternative implementation, the pylon 106 defines a rail and the arm 116 has an articulated channel in which the rail is received, thus permitting the arm 116 to pivot and slide relative to the pylon 106. In another alternative implementation, the arm 116 is pivotally connected to the deck 14 and pivotally, but not slidingly, connected to the pylon 106. In such an implementation, the arm 116 is made of at least two parts that can slide relative to one another, thus permitting the arm 116 to have a variable length such that the arm would be contracted when the pylon 106 is in the stowed position and extended when the pylon 106 is in the towing position. It is contemplated that in such an implementation, the parts of the arm 116 could be biased such that the arm 116 would bias the pylon 106 toward the towing position. In yet another alternative implantation in which the arm 116 is pivotally connected to the deck 14 and pivotally, but not slidingly, connected to the pylon 116, the arm 116 is made of at least two parts that can pivot relative to one another, thereby permitting the arm 116 to fold when in the stowed position. The arm 116 defines an aperture 210 therethrough. A grommet 212 is inserted at one end of the aperture 210. The grommet 212 abuts the central member 164 of the handle 110 when the pylon 106 is in the stowed position, thereby acting as a bumper between the arm 116 and the handle 110.

Figure 11:
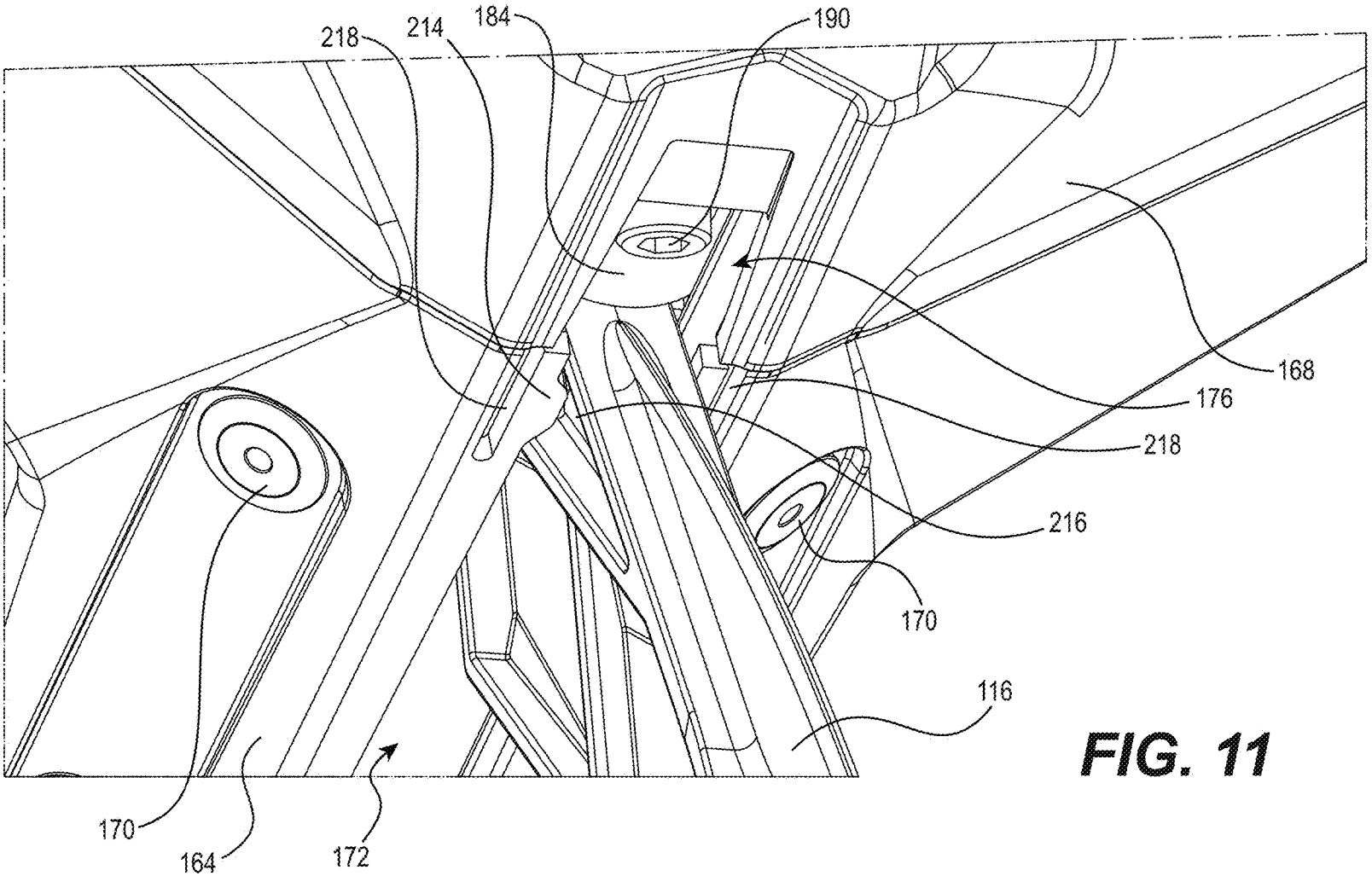
FIG. 11 is a bottom perspective view showing a connection between the underside of the handle and an arm of the tow pylon assembly when the pylon is in the towing position.

In the stowed position (FIG. 1), the pylon 106 and the handle 110 rest against the arm 116 and the arm 116 is almost parallel to the pylon 106. In this position, the pylon 106 extends upward and forward from the base 104 and the arm 116 extends rearward and downward from the tow eye 32 as can be see in FIG. 1. In the stowed position, the ball 206 of the arm 116 is located near a longitudinal center of the pylon 106. To move the pylon 106, and therefore the pylon assembly 100, from the stowed position (FIG. 1) to the towing position (FIG. 2), the strap 112 is first untied from the grab handle 30. The handle 110 is then pulled upward and rearward so as to pivot the pylon 106, and therefore the equipment holding assembly 108, the handle 110 and the bollard 114, counter-clockwise (with reference to the orientation of FIGS. 1 and 2). As the pylon 106 pivots counter-clockwise, the ball 206 of the arm 116 slides inside the channel 146 toward the upper end of the pylon 106 and the arm 116 pivots clockwise about the tow eye 32 (with reference to the orientation of FIGS. 1 and 2). When the arm 116 abuts the pin 184, as shown in FIG. 9, protrusions 214 defined by the central member 164 of the handle 110 are received inside recesses 216 defined on either side of the arm 116 as can be seen in FIG. 11, thereby maintaining the pylon 106, and therefore the tow pylon assembly 100, in the towing position shown in FIG. 2. In the towing position 116, the arm 116 supports the pylon 106 and prevents pivoting of the pylon 106 back toward the stowed position. In this position, the pylon 106 extends upward and forward from the base 104 and the arm 116 extends rearward and upward from the tow eye 32 as can be see in FIG. 2. As can be seen by comparing FIGS. 1 and 2, the pylon 106 is closer to vertical in the towing position than in the stowed position. In the towing position, the tow rope 102 can be tied around the bollard 114 and the watercraft 10 can be used to tow a wakeboarder for example, while the handle 110 can be used to stabilize a spotter.

To move the pylon 106, and therefore the tow pylon assembly 100, back to the stowed position, pressure is applied downward and rearward on the arm 116, thereby causing the protrusions 214 to move laterally outward due the presence of slots 218 (FIG. 11) in the central member 164 and releasing the arm 116. The ball 206 of the arm 116 then slides inside the channel 146 toward the lower end of the pylon 106, the arm 116 pivots counter-clockwise about the tow eye 32 and the pylon 106 pivot clockwise (with reference to the orientation of FIGS. 1 and 2) until the pylon 106 and handle 110 rest against the arm 116.

Turning now to FIGS. 3, 5, 8, 9, 12 and 13, the equipment holding assembly 108 will be described. As described above, the equipment holding assembly 108 includes the support 148. The equipment holding assembly 108 also includes a cap 220 and a resilient member 222. It is contemplated that in some implementations of the present technology, the cap 220 could be omitted.

Figure 8:
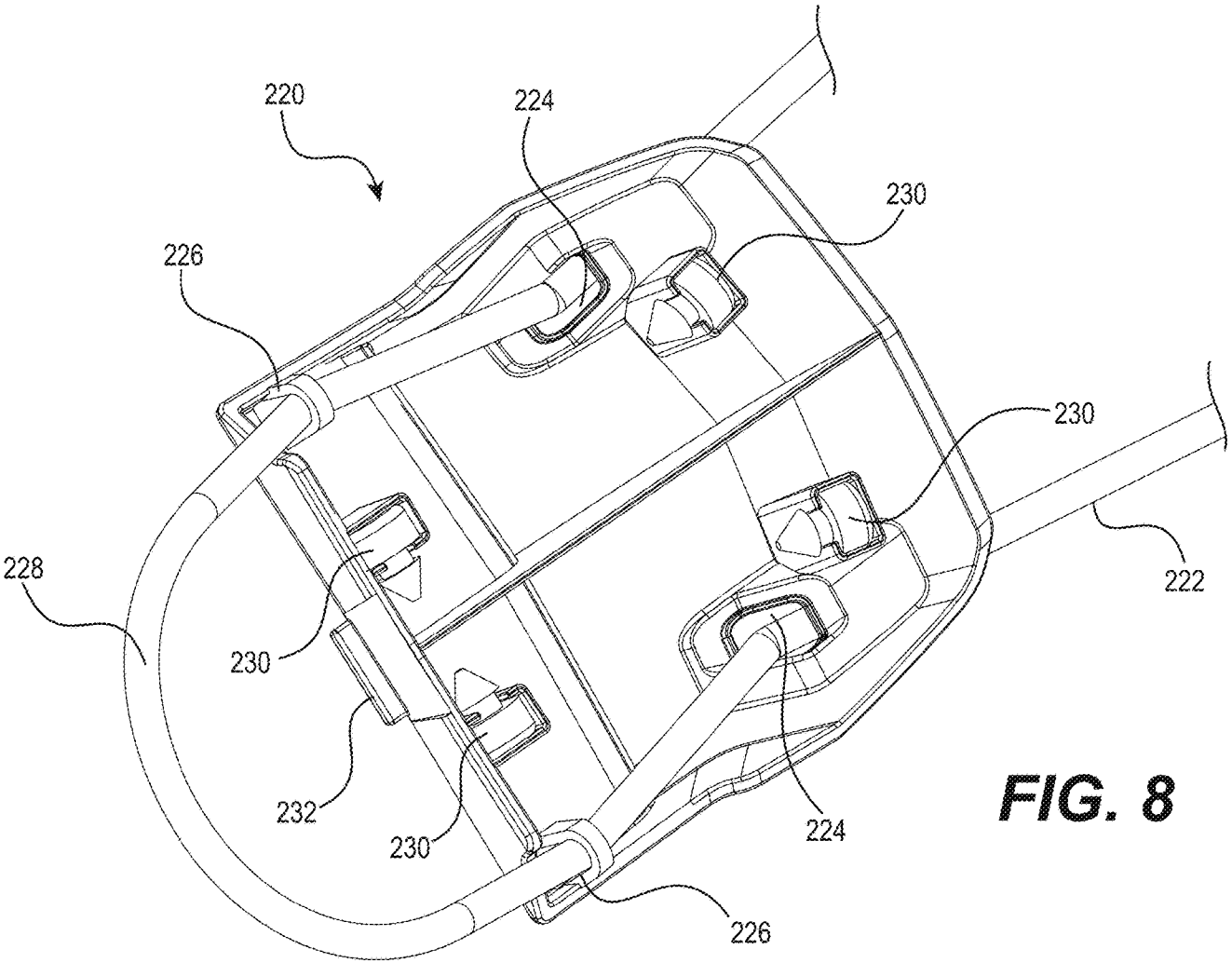
FIG. 8 is a bottom perspective view of a cap and a portion of an elastic of the tow pylon assembly of FIG. 3.

In the present implementation, the resilient member 222 is an elastic 222 made of rubber, but it is contemplated that another type of resilient member could be used. The elastic 222 extends through apertures 224, 226 in the cap 220. As can be seen, the apertures 224 are laterally closer to each other than the apertures 226. The ends of the elastic 222 are knotted and inserted between the central member 164 and the cap 168 of the handle 110. As a result, the ends of the elastic 222 are connected to the upper portion of the pylon 106 via the handle 110. The ends of the elastic 222 are laterally further from each other than the apertures 224 and the apertures 226. The center portion 228 of the elastic 222 is selectively looped around the support 148 to tension the elastic. When the center portion 228 of the elastic 222 is looped around the support 148, it rests against de corners defined by the inverted L-shaped surfaces 156 as can be seen in FIG. 3. As can be seen in FIG. 8, four bumpers 230 are press-fitted in the bottom of the cap 220 and protrude therefrom. The cap 220 also defines a protrusion 232.

As shown in FIGS. 3 and 9, when no equipment is held by the equipment holding assembly 108, the cap 220 is positioned on the support 148 so as to block the gap defined by the recess 154. As can be seen in FIG. 9, the protrusion 232 is received in a recess 234 in the support 148, which prevents lateral movement of the cap 220. The center portion 228 of the elastic 222 is looped around the support 148 to tension the elastic and help maintain the cap 220 in position.

A method of mounting the wakeboard 250 to the tow pylon assembly 100 using the equipment holding assembly 108 will now be described. Although the method will be described using the wakeboard 250, it is contemplated that equipment other than a wakeboard could be held by the equipment holding assembly 108, such as other sports implements or a spare personal floatation device for example. The wakeboard 250 can be mounted to the tow pylon assembly 100 with the tow pylon assembly 100 in the towing position or in the stowed position. The tow pylon assembly 100 can be moved between the towing and stowed positions with the wakeboard 250 mounted to it.

The center portion 228 of the elastic 222 is first removed from around the support 148, thereby releasing the tension in the elastic 222. Once the elastic 222 is released from the support 148, the edge 252 of the wakeboard 250 is inserted in the recess 154 defined by the support 148 such that the wakeboard 250 rests on the support 148. The bottom surface of the wakeboard 250 abuts the bumpers 160 of the support 148. The wakeboard 250 is then laid down against the central member 164 of the handle 110. It is contemplated that bumpers similar to the bumpers 160 of the support 148 could be provided on the central member 164 so as to abut the bottom surface of the wakeboard 250. As a result, the wakeboard 250 is generally parallel to the pylon 106. As can be seen, the wakeboard 250 is generally laterally centered relative to the tow pylon assembly 100, but it does not have to be perfectly centered. The cap 108 is slid along the elastic 222 such that when the elastic 222 is looped around the support 148, the cap 108 is generally at the center of the upper surface wakeboard 250. As shown in FIG. 12, the elastic 222 is finally pulled rearward over the wakeboard 250 between the bindings 254 (schematically illustrated) of the wakeboard 250 and looped around the support 148 as described above, thereby tensioning the elastic 222 and holding the wakeboard 250 between the elastic 222 and the pylon 106.

As can be seen in FIG. 13, the center portion 228 of the elastic 222 is offset from a plane containing the upper surface of the wakeboard 250. As a result, the tensioned elastic 222 pushes the wakeboard 250 toward the pylon 106 thereby holding it in position relative to the tow pylon assembly 100. The elastic 222 also pushes the cap 220 against the wakeboard 250, and the friction between the bumpers 230 of the cap 220 and the upper surface of the wakeboard 250 also help maintain the wakeboard 250 in position. Also, by having the apertures 224 closer to each other than the apertures 226 and the ends of the elastic 222, when the elastic 222 is in tension, the cap 220 does not have a tendency to slide along the elastic 222 unless an external force acts on the cap 220, such as a user pushing on the cap 220 for example.

To remove the wakeboard 250 from the tow pylon assembly 100, the center portion 228 of the elastic 222 is removed from around the support 148 and the wakeboard 250 is then free to be removed. The cap 220 and the elastic 222 are then repositioned as shown in FIG. 3.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A tow pylon assembly for a watercraft comprising:

a base configured for connecting the tow pylon assembly to the watercraft;

a pylon having a lower portion pivotally connected to the base, the pylon being pivotable between a towing position and a stowed position, the pylon being closer to vertical in the towing position than in the stowed position;

an arm having a first end pivotally and slidably connected to the pylon and a second end configured for being pivotally connected to the watercraft, the arm pivoting relative to the pylon as the pylon pivots between the towing and stowed positions, the arm supporting the pylon and preventing pivoting of the pylon toward the stowed position when the pylon is in the towing position;

a handle connected to an upper portion of the pylon, the handle being configured to be held by a passenger of the watercraft when the pylon is in a towing position;

a bollard connected to the upper portion of the pylon, the bollard being configured for attaching a tow rope to the tow pylon assembly; and an equipment holding assembly connected to the pylon, the equipment holding assembly comprising a resilient member connected to the pylon, the resilient member being configured for pushing equipment toward the pylon for holding the equipment between the resilient member and the pylon, the bollard, the equipment holding assembly and the handle pivoting with the pylon relative to the base as the pylon pivots between the towing position and the stowed position.

2. The assembly of claim 1, further comprising:

a strap connected to the handle, the strap being configured to connect the handle to a portion of the watercraft when the pylon is in the stowed position.

3. The assembly of claim 1, wherein the equipment holding assembly further comprises a support connected to a lower portion of the pylon, the support defining a recess configured to receive an edge of the equipment therein.

4. The assembly of claim 3, wherein:

the resilient member is an elastic having ends and a center portion;

the ends of the elastic are connected to the upper portion of the pylon;

the center portion of the elastic is selectively looped around the support; and the elastic is configured to hold equipment between the elastic and the pylon when the center portion of the elastic is looped around the support.

5. The assembly of claim 4, wherein:

the equipment holding assembly further comprises a cap;

the elastic extends through the cap;

the cap is slidable along the elastic between a first position and a plurality of second positions;

in the first position, the cap is received at least in part in the recess; and in the second position with the elastic looped around the support, the cap is disposed between the support and an upper end of the pylon and is configured to abut a surface of equipment held between the elastic and the pylon.

6. The assembly of claim 1, wherein the equipment is a wakeboard.

7. A watercraft comprising:

a hull;

a deck disposed on the hull, a rear portion of the deck defining a platform, the deck defining a pedestal;

a straddle seat disposed on the deck at least in part forward of the platform, the straddle seat being disposed on the pedestal;

a base connected to the platform;

a pylon having a lower portion pivotally connected to the base, the pylon being pivotable between a towing position and a stowed position, the pylon being closer to vertical in the towing position than in the stowed position, the pylon being rearward of the pedestal at least when in the towing position;

a tow eye connected to a rear of the pedestal;

an arm having a first end pivotally and slidably connected to the pylon and a second end pivotally connected to the tow eye, the arm pivoting relative to the pylon as the pylon pivots between the towing and stowed positions, the arm supporting the pylon and preventing pivoting of the pylon toward the stowed position when the pylon is in the towing position;

a handle connected to an upper portion of the pylon, the handle being configured to be held by a passenger of the watercraft when the pylon is in a towing position;

a bollard connected to the upper portion of the pylon, the bollard being configured for attaching a tow rope; and an equipment holding assembly connected to the pylon, the equipment holding assembly comprising a resilient member connected to the pylon, the resilient member being configured for pushing equipment toward the pylon for holding the equipment between the resilient member and the pylon, the bollard, the equipment holding assembly and the handle pivoting with the pylon relative to the base as the pylon pivots between the towing position and the stowed position.

8. The watercraft of claim 7, wherein:

the handle is a second handle; and the watercraft further comprises:

a first handle connected to the deck and disposed at least in part rearward of the straddle seat; and a strap connected to the second handle, the strap selectively connecting the second handle to the first handle when the pylon is in the stowed position.

9. The watercraft of claim 7, wherein the equipment holding assembly further comprises a support connected to a lower portion of the support, the support defining a recess configured to receive an edge of the equipment therein.

10. The watercraft of claim 9, wherein:

the resilient member is an elastic having ends and a center portion;

the ends of the elastic are connected to the upper portion of the pylon;

the center portion of the elastic is selectively looped around the support; and the elastic is configured to hold equipment between the elastic and the pylon when the center portion of the elastic is looped around the support.

11. The watercraft of claim 10, wherein:

the equipment holding assembly further comprises a cap;

the elastic extends through the cap;

the cap is slidable along the elastic between a first position and a plurality of second positions;

in the first position, the cap is received at least in part in the recess; and in the second position with the elastic looped around the support, the cap is disposed between the support and an upper end of the pylon and is configured to abut a surface of equipment held between the elastic and the pylon.

12. The watercraft of claim 7, wherein the equipment is a wakeboard.

* * * * *